United States Patent [19]

Meyer

[11] Patent Number: 4,550,915

[45] Date of Patent: Nov. 5, 1985

[54] GAME WITH TRIANGULAR SHAPED PLAYING ELEMENTS

[76] Inventor: William D. Meyer, 2816 Sutton Blvd., St. Louis, Mo. 63143

[21] Appl. No.: 712,478

[22] Filed: Mar. 18, 1985

Related U.S. Application Data

[63] Continuation of Ser. No. 557,258, Dec. 2, 1983, abandoned.

[51] Int. Cl.[4] ..... A63F 3/00

[52] U.S. Cl. ..... 273/272; 273/294

[58] Field of Search ..... 273/272, 273, 294

[56] References Cited

U.S. PATENT DOCUMENTS

| | | | |
|---|---|---|---|
| 3,267,590 | 8/1966 | Browning | 273/272 |
| 3,638,947 | 2/1972 | Hardesty | 273/294 X |
| 4,244,580 | 1/1981 | Hoyles | 273/272 |
| 4,331,333 | 5/1982 | Willcocks | 273/272 X |

FOREIGN PATENT DOCUMENTS

| | | | |
|---|---|---|---|
| 132181 | 3/1933 | Austria | 273/294 |
| 599951 | 10/1925 | France | 273/272 |
| 762498 | 1/1934 | France | 273/294 |
| 747598 | 4/1956 | United Kingdom | 273/272 |

OTHER PUBLICATIONS

"Boggle" pp. 23, 26, 27 of Games & Puzzles Magazine, Apr. 1977.

*Primary Examiner*—Harland S. Skogquist

*Attorney, Agent, or Firm*—Haverstock, Garrett & Roberts

[57] ABSTRACT

A game of forming words on a playing surface including a plurality of triangular shaped playing pieces each marked on one side with either a letter, number, symbol or combinations thereof, which letters, numbers and symbols are for arranging on a playing surface having correspondingly shaped triangular spaces thereon to form words of the adjacent pieces and to control the playing strategy of the game.

8 Claims, 4 Drawing Figures

GAME WITH TRIANGULAR SHAPED PLAYING ELEMENTS

This is a continuation of co-pending application Ser. No. 557,258 filed on Dec. 2, 1983 and now abandoned.

The present invention relates to a game comprising a plurality of triangularly shaped playing pieces marked with letters, numbers and/or symbols, racks for holding the playing pieces, and a playing surface or game board. The letters, numbers and symbols on the playing pieces relate to one another in a novel way, such relationship allowing a series of game plays which enable the game players to accumulate point scores in a novel way by the relationship between the playing pieces on the playing surface.

Each of the playing pieces, in the preferred embodiment, is of a substance such as plastic or wood formed into a triangular shape such as into an equilateral triangle. The playing pieces are each marked on one triangular face with either a letter of the alphabet and an indication of that letter's point value, a representation of a number, or a symbol which represents one of several possible non-letter game moves. The playing pieces preferably have smooth surfaces and may have rounded corners to make them comfortable to handle.

Each player has a rack for holding his or her playing pieces and each rack is an elongated structure having spaced parallel flanges projecting upwardly therefrom and positioned to support a plurality of playing pieces in orientation to be viewed by the player who has drawn the pieces during play but not by the other players.

The playing surface or game board is generally of rectangular shape and has a pattern of lines thereon defining adjacent triangular shaped spaces, each of which corresponds in size and shape to the size and shape of the triangular playing pieces.

It is known to use triangular shaped game pieces and it is also known to have game pieces marked with letters which are used to form words, but the combination of triangular shaped playing pieces marked with letters and non-letter symbols as herein shown and described and used with a playing surface as also described to enable the playing pieces to be positioned to form words in as many different arrangement possibilities as herein set forth presents a new and challenging game.

The well known word forming game Scrabble has letters marked on square shaped playing pieces and uses racks to hold the playing pieces. The playing surface or board in Scrabble has square shaped playing spaces arranged in parallel rows and columns. As the game proceeds, each player takes his turn by laying down pieces which he has in his rack, thereby forming new words with his newly laid down pieces and with other pieces which have been laid down in previous turns. Words formed with playing pieces in the Scrabble game must each be formed of playing pieces which lie in a straight line either in a row or in a column. With the present game, however, it is possible with the playing pieces to form words which do not have all their letters arranged in a straight line but which may have their letters arranged in many more different configurations, the only requirement being that adjacent letters in each word that is formed must be on playing pieces which touch at some point. For instance, playing pieces which abut along common sides or which join only at their respective corners may be used as adjacent letters to form words. Thus, words may be formed of letter pieces which relate to each other in a greater variety of possibilities than previously known games thereby increasing the number of word possibilities and the game complexity.

Applicant's game has the added feature of strategy motivators in the form of non-letter playing pieces which may be played by players who draw these pieces during a turn. These pieces, which are named "steal-a-score", "add-a-turn", "skip-a-turn", "any letter", "double-a-score" and "triple-a-score", add to the playing strategy of the game and enable players with more limited vocabulary skills to have a better chance of winning. This is different from spelling games such as Boggle and the aforementioned Scrabble where all of the playing pieces are marked only with letters or blanks and, in Scrabble, the double and triple score spaces are marked on the playing surface so that their occurrence in the game is predictable and expected. Applicant's game, on the other hand, allows these strategy motivators to be played unexpectedly at any stage of the game. The non-letter pieces also allow the course of the present game to change quickly causing sudden shifts in a player's standing thereby adding to the game interest and strategy and increasing the excitement of playing the game.

A known game which uses triangularly shaped pieces is Tri-Ominos. In this game one face of each playing piece is marked with three numbers, each number corresponding to a corner of the equilateral triangular face. A turn in the game of Tri-Ominos consists of laying down a playing piece so that at least one edge of each newly played piece adjoins an edge of a previously played piece and so that the numbered corners of the newly played piece match the numbers of the respective corners of the previously played piece or pieces with which they adjoin somewhat like in the game Dominos.

Applicant's game differs substantially from Tri-Ominos in that each playing piece is assigned a letter or symbol, rather than having the corners of the playing pieces each being assigned a number. In Tri-Ominos, only the relationship of adjacent corners of adjacent pieces is important when a piece is played. In the present game, on the other hand, extended series of playing pieces are formed in each turn, these series of pieces spelling words by the relation of adjacent and non-adjacent pieces. Pieces which abut at adjacent sides or at adjacent corners may relate as adjacent letters of a word and pieces which do not join may relate to each other as non-adjacent letters in a word.

The present game is also different than the above mentioned games in that the non-letter playing pieces may be placed to block potential moves by opposing players. All of the non-letter pieces except the "any letter" piece may only be used by the player playing that piece in the turn in which it is played. An opposing player cannot make use of these pieces nor the spaces on which they lie. By playing one of the non-letter playing pieces, a player may prevent an opponent from completing a potentially large scoring future move. Thus, the non-letter playing pieces may serve simultaneously as strategy motivators to cause unexpected plays, as described previously, and as blocking pieces to hinder potential plays by an opponent.

It is a principal object of the present invention to teach the construction and playing of a game which allows words to be formed by letters on playing pieces in a novel way.

Another object of the invention is to teach a word forming game which allows less skilled spellers to compete effectively with better spellers and with players who have bigger vocabularies.

Another object is to teach a spelling game with letter and non-letter playing pieces which allow a wide variety of plays and play combinations and enables players of unequal skills to compete effectively.

Another object is to teach a novel word game which affords a greater number of word combinations to be made with each playing piece.

Another object is to teach a game using non-letter strategy motivators which may be played unexpectedly during the game.

Another object is to teach a word game that requires increased strategy.

Another object is to increase the vocabulary of persons playing the present word game.

Another object is to teach the construction and playing of a novel word game that is relatively easy to learn to play and can be played by persons of widely varying skills and vocabularies.

Another object of the invention to teach a game which is exciting to play for players of many skill levels.

These and other objects and advantages of the present invention will become apparent to those skilled in the art after considering the following detailed specification of a preferred embodiment of the present game in conjunction with the accompanying drawings, wherein.

Figure 1:
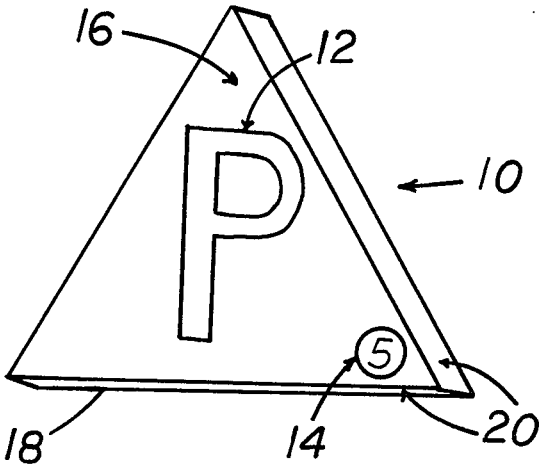
FIG. 1 is a perspective view of a typical one of the playing pieces of the present game showing the markings thereon.

Referring to the drawings more particularly by reference numbers wherein like members refer to like parts, number 10 in FIG. 1 identifies generally one of many triangular shaped playing pieces used with the present game. A letter "P" 12 is marked on triangular face 16 as well as the point value 14 for the letter P, the point value being shown here as a "5" in a small circle. In a complete set of playing pieces, typically about 100 pieces, each letter of the alphabet is marked on at least one playing element and each letter is assigned a point value, which value is based on the average expected difficulty or frequency in playing that letter. The point scores on the playing pieces are utilized in the accumulation of a score. The point value of each letter in the alphabet corresponds inversely to its frequency of use in the language, the more frequently used letters having lower point values and the less frequently used letters having higher point values. Also, the number of playing pieces in a set having a particular letter on them varies with the frequency of use of that letter in the language.

Figure 2:
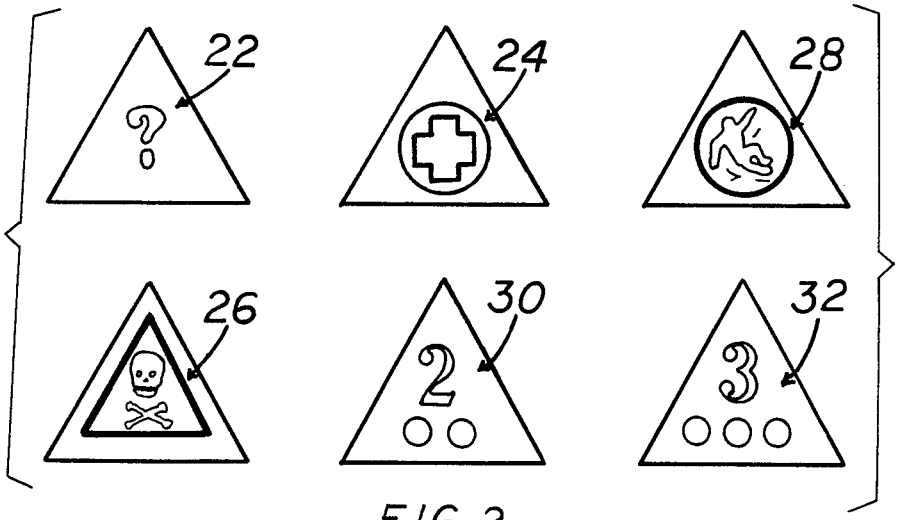
FIG. 2 shows six playing pieces similar to that shown in FIG. 1, each having marked thereon a different one of the non-letter symbols.

In addition to the letter pieces, there are six types of non-letter strategy motivator playing pieces, each of which is shown in FIG. 2. First is the "any letter" symbol on some pieces, such as playing piece 22 in FIG. 2, which may be used in place of any letter of the alphabet in forming a word and which may be used as a different letter for each turn during a game. Second is the "add-a-turn" symbol on playing piece 24 in FIG. 2, which allows the player playing these pieces to replenish the pieces he has played during his turn and take an additional turn once his current turn is over. The "steal-a-score" symbol, shown on playing piece 26 in FIG. 2, may be used by the player who draws this piece to take the score of a player who has just completed his turn and to subtract this point score from the score of the player from whom it was taken. The "skip-a-turn" piece on playing piece 28 in FIG. 2, when drawn and used by a player causes the player with the highest score to forfeit his next turn. Finally, there are two types of numerical pieces, a "double score" type piece, playing piece 30 in FIG. 2, and a "triple score" type piece 32 each of which may be used by a player drawing them during his turn to double, or triple respectively, his score from that turn.

The opposite triangular shaped face 18 and the edge faces 20 of the playing pieces, as shown in FIG. 1, are blank or marked with a design or color which is uniform for all playing elements in the set. Also, all of playing elements or pieces in a set are of the same size, shape and color; the size and shape being selected to correspond to the size and shape of the areas on the playing surface as will be described later. In one embodiment, the playing pieces are equilateral triangles selected to be about $\frac{1}{8}$ inch or less thick and about $1\frac{1}{2}$ inches on each side. The playing elements are of a material such as plastic or wood, and are opaque so that the letters or symbols marked on them are not visible from the unmarked side 18. To start the game the playing pieces are all turned face down and are scrambled so that the selection of pieces by the players as the game proceeds is random.

Figure 3:
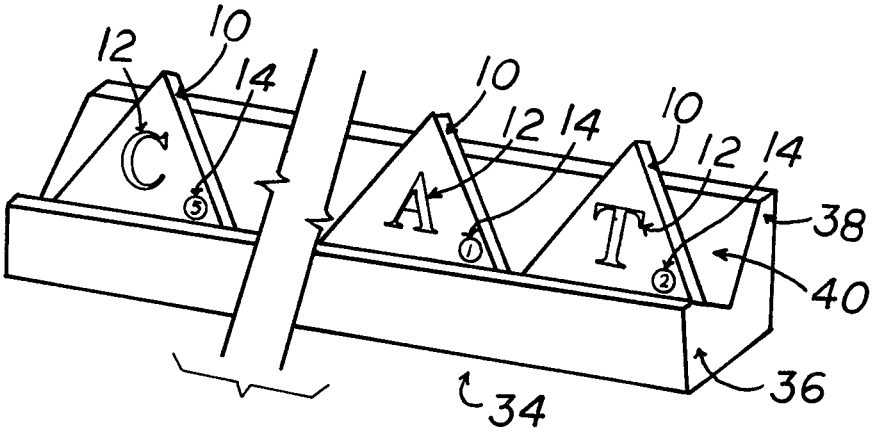
FIG. 3 is an perspective view of one of the holding racks for the playing pieces showing a plurality of playing piece similar to that of FIG. 1 positioned thereon.

FIG. 3 discloses a holder rack 34 for holding the playing pieces of a player in such position that the letters and/or symbols on them are visible to the player whose pieces are supported thereon but not to the other players. The holder rack 34 is an elongated structure shown with spaced side flanges 36 and 38 extending along opposite side edges thereof. The flanges 36 and 38 define a trough shaped space 40 into which the playing pieces can be positioned as shown. Other embodiments of the holder rack are also possible, so long as they perform the function of allowing only one player to view the marked faces of his playing pieces.

Figure 4:
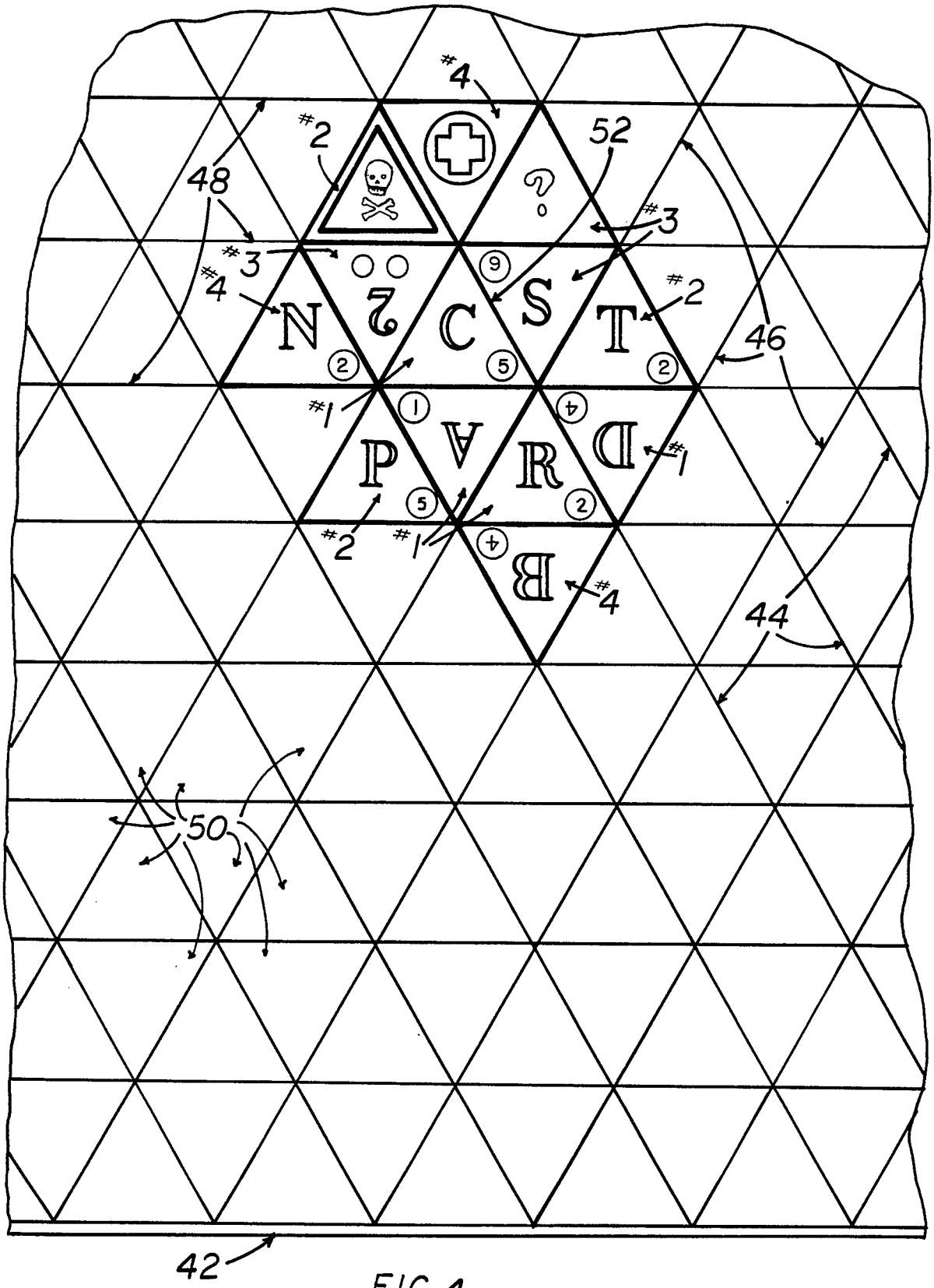
FIG. 4 is a top plan view of a portion of a playing surface or game board for the present game showing an arrangement of some of the playing pieces thereon as the game proceeds.

FIG. 4, which shows the playing surface 42 and an arrangement of playing pieces positioned thereon after several turns of play. The playing surface 42 has marked thereon a grid formed by three sets of spaced parallel lines 44, 46 and 48 which form a continuous pattern of adjacent triangular playing spaces 50, each of which is sized and shaped to accommodate one of the playing pieces. The playing surface 42 may be as large or small as desired depending on the number of playing pieces it is able to accommodate and the desired complexity of the game. One of the triangular shaped spaces 52 near the center of the playing surface is labeled "start". The playing surface may be printed on a piece of flexible material such as on paper or plastic or it may be formed on a hard surface such as on wood or a hard plastic material, and it is contemplated that, when the playing surface is hard, raised portions or ridges may be provided between the adjacent playing spaces 50 to help locate the playing pieces and prevent them from moving after they are played.

Play commences as follows: once it has been determined who among the players will make the first play, which may be done by each player selecting one playing piece from a group of face-down playing pieces, the one selecting the letter nearest the beginning of the alphabet being the first player. The players each select a predetermined number of pieces, such as seven playing pieces, from the group of pieces which are in a face-down arrangement. Each player then places the playing pieces he has selected in his holder 34 so that only the player who selected the pieces may view the faces of the pieces that have the information thereon. The first player now places his playing pieces on the playing surface 42, first placing one of the pieces on the playing space 52 which is the space marked "start". Before the first player can place any of his pieces on the playing surface he must be able to spell at least one word from the pieces so placed. This is done by laying down the first piece in the triangular area marked "start" and laying down subsequent letter or other pieces adjacent that first piece to spell the desired word. Each subsequently played piece must adjoin at least one previously played playing piece along one side, but, the adjacent letters used to form a word can be on pieces adjacent along a side or on adjacent pieces that only touch at a corner.

In the arrangement shown in FIG. 4, the pieces played by each of the four players are marked with a number corresponding to the respective players to clarify the explanation of the game. In the example, player number one, who was the first player, played the letters C, A, R, and D as indicated by the pieces marked #1, to spell the word "card". The score for player #1 on his first turn is 12 which is the sum of the points assigned the playing pieces used by player #1 in his turn. The points assigned the letters used here are C=5, A=1, R=2 and D=4. Player #1 now draws four more playing pieces from the stock of pieces arranged face-down so that the number of pieces remaining on his rack 34 is the same as the number of pieces originally selected. The second player (#2) now takes his turn and places the playing pieces which for convenience of explanation are shown having #2 on them on the playing surface. In this case player #2 plays a P and a T, spelling the words "part". As can be seen, the R and T pieces in the word "part" adjoin only at corners but still may be counted as spelling words. Player #2 scores 5+1+2+2=10 points for spelling "part".

Player #3 has added pieces #3 which include a letter S, ?, and a 2 to spell the word "drastic". The ?, which is an "any letter" symbol 22, is used by player #3 as the letter "I" to complete the word. Although the ? playing piece has no assigned point value for scoring purposes it enables player #3 to complete his declared word and to score points. Player #3 in addition to playing the playing piece ? has played a "double score" piece 30 which blocks the space on which it is played and has the effect of doubling his point score for his turn which is equal to (4+2+1+3+2+0+5)×2=34 points.

It is now the turn of player #4 and he adds the playing pieces for B and N to spell the word "branch". He also plays an "add-a-turn" playing piece 24. "Branch" is spelled by making the "any letter" symbol (?), previously played, to be the letter H for this turn. As player #4 is finishing his first turn, player #2, who holds a "steal-a-score" playing piece 26, uses his option to play the piece which has the effect of causing player #4 to lose the points he has just scored for his turn, and player #2 gets these points instead which total 4+2+1+2+5+0=14 for the word "branch". Since only players #4's score has been stolen by the playing of the "steal-a-score" piece, player #4 may now take another turn as indicated by the "add-a-turn" piece. Play continues in this manner until all the playing pieces have been drawn from stock and one player has played all of the playing pieces left in his holder or until no one is able to make a further play. The scores are then totaled and the player with the highest score wins.

With the present game construction it is possible to provide a very complicated game and yet one that enables players with less skill and/or less vocabulary to be able to compete by allowing them to take scores away from the more skilled players and by adding other strategies to the playing of the game.

Thus there has been shown and described a novel game playing apparatus for forming words using triangular shaped playing pieces with distinctive indicia thereon and with a distinctive playing surface that accommodates the playing pieces in particular relationships, which apparatus fulfills all of the objects and advantages sought therefor. Many changes, modifications, variations and other uses and applications of the present construction will become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. A game played by forming words from adjacent triangular shaped playing pieces played in sequential turns by game players wherein one or more words are formed by letters appearing on playing pieces placed adjacent to one another in side by side relationship on a playing surface whereby words can be formed by combinations of letters appearing on adjacent playing pieces comprising a playing surface and a plurality of playing pieces each having the same size and triangular shape to be placed by players in sequence on the playing surface, one triangular shaped surface of each playing piece being marked with a symbol, the symbols on selected ones of said playing pieces being letters of the alphabet and point values associated therewith, the symbols on selected other playing pieces including distinctive indicia used to control the game strategy, said distinctive indicia including first indicia on some of the playing pieces to increase a players point score for a word formed, second indicia to be used as a substitute letter for any letter of the alphabet as an aid to forming a word, and third distinctive indicia to award the player playing that piece an option in the order of plays by the game players as by allowing manipulation of a player's turn.

2. A word forming game comprising a playing surface and a plurality of playing pieces distributable to players thereof for placing adjacent to one another on the playing surface, each of the playing pieces having the same triangular shape, a symbol marked on one triangular shaped surface of each playing piece, the symbols on selected ones of said playing pieces being letters of the alphabet and point values associated therewith, the symbols on selected other playing pieces including a first distinctive symbol appearing on a first group of the selected other playing pieces which can be used as a substitute for any letter of the alphabet to increase the number of possible words that can be formed by combining letters appearing on adjacent playing pieces during the course of the game, and a second distinctive symbol appearing on a second group of the selected other playing pieces allowing manipulation of a player's turn, the placement of said playing pieces on the playing surface by the players taking place in turn by placing of the playing pieces adjacent each other to form words, words being formed by the letters and symbols on the adjacent playing pieces on the playing surface as each of the players plays his playing pieces in turn.

3. A word forming type game wherein the consecutive letters that form a word are on playing pieces placed in positions adjacent one another on a playing surface by players who play their playing pieces in turn comprising a playing surface having a plurality of adjacent triangular shaped playing spaces arranged thereon in a pattern of contiguous playing spaces, and a plurality of triangular shaped playing pieces which are sized and shaped to correspond to the size and shape of the contiguous playing spaces on the playing surface, a first group of the playing pieces each having a distinctive letter of the alphabet and a corresponding number weighted to correspond inversely to the frequency of use of the letter on the playing piece in the language formed on corresponding triangular shaped faces, an object of the game being for the players to whom the playing pieces are distributed to take turns in sequence by placing selected ones of the playing pieces distributed to them to form words with others of the playing pieces already on the playing surface, the point score value of each of the words so formed being related to the sum of the numbers appearing on the playing pieces that form the word, and other distinctive indicia used to control the game strategy including a second group of the playing pieces having distinctive symbols thereon allowing manipulation of a player's word score, a third group of the playing pieces having distinctive symbols thereon allowing manipulation of a player's turn, and a fourth group of the playing pieces having distinctive symbols thereon allowing increased combinations of the letters to produce words from arrangements of the adjacent playing pieces formed on corresponding faces of selected ones of the playing pieces of the first group.

4. The game of claim 3 wherein the playing surface has a centrally located playing space with a legend to identify where the game is to commence.

5. The game of claim 3 wherein selected ones of the playing pieces have a symbol thereon to indicate the transfer of a score for a just completed turn from the player completing the turn to the player playing such piece.

6. The game of claim 3 wherein selected ones of the playing pieces have a symbol thereon to mandate the skipping of a turn by the player with the highest score when such piece is played.

7. The game of claim 3 including a holder device for each player of the game, said holder devices being constructed to hold a plurality of the playing pieces in positions so that only the player who drew the playing pieces is able to see the letters and symbols thereon.

8. The game of claim 3 wherein the playing pieces and the playing spaces are each formed as equilateral triangles.

* * * * *